United States Patent [19]

Ibrahim

[11] 4,338,792

[45] Jul. 13, 1982

[54] REFRIGERATED MERCHANDISER DISPLAY CASE WITH DEFROST DEVICE

[75] Inventor: Fayez F. Ibrahim, Niles, Mich.

[73] Assignee: Tyler Refrigeration Corporation, Niles, Mich.

[21] Appl. No.: 225,997

[22] Filed: Jan. 19, 1981

Related U.S. Application Data

[63] Continuation-in-part of Ser. No. 60,459, Jul. 25, 1980, Pat. No. 4,295,340, which is a continuation-in-part of Ser. No. 8,111, Jan. 31, 1979, Ser. No. 11,804, Feb. 14, 1979, Ser. No. 25,350, Mar. 30, 1979, Ser. No. 76,669, Sep. 18, 1979, and Ser. No. 145,859, May 1, 1980.

[51] Int. Cl.[3] ..... A47F 3/04

[52] U.S. Cl. ..... 62/256; 62/282; 98/33 R

[58] Field of Search ..... 62/256, 82, 282; 114/211; 220/426; 98/33 R

[56] References Cited

U.S. PATENT DOCUMENTS

| | | | |
|---|---|---|---|
| 2,725,726 | 12/1955 | Swanson | 62/256 X |
| 2,923,137 | 2/1960 | Swanson | 62/256 |
| 4,026,121 | 5/1977 | Aokage et al. | 62/256 X |
| 4,120,174 | 10/1978 | Johnston | 62/256 |
| 4,275,645 | 6/1981 | Ruff | 62/256 X |

FOREIGN PATENT DOCUMENTS

| | | | |
|---|---|---|---|
| 2804008 | 8/1978 | Fed. Rep. of Germany | 62/256 |

*Primary Examiner*—William E. Tapolcai, Jr.
*Attorney, Agent, or Firm*—LeBlanc, Nolan, Shur & Nies

[57] ABSTRACT

An improvement in a refrigerated display case in which an air flow restriction baffle is positioned adjacent to the discharge end of the air conduit containing the defrost ambient air band. The baffle increases the linear velocity of the air band and the air momentum sufficiently to cause the band to flow away from the access opening of the display case whereby continuous recirculation of the defrost air is avoided. The baffle can form a restricted air flow cross-sectional area which is about 50% to 90% of the cross-sectional area of the air flow conduit immediately proceeding the position of the baffle. A restricted air flow area of these amounts enable a linear velocity increase of about 10% to 100% based on the air band velocities normally used during defrost cycles.

32 Claims, 6 Drawing Figures

REFRIGERATED MERCHANDISER DISPLAY CASE WITH DEFROST DEVICE

RELATED APPLICATIONS

The present application is a continuation-in-part of application Ser. No. 60,459, filed July 25, 1980 now U.S. Pat. No. 4,295,340, which application is, in turn, a continuation-in-part of applications Ser. No. 8,111 filed Jan. 31, 1979, Ser. No. 11,804 filed Feb. 14, 1979 and Ser. No. 25,350 filed Mar. 30, 1979; and of applications Ser. No. 76,669 filed Sept. 18, 1979; and Ser. No. 145,859 filed May 1, 1980. The disclosures of all these applications are hereby incorporated by reference as though fully set forth herein.

BACKGROUND OF THE INVENTION

The present invention relates to a merchandiser type refrigerated display case or cabinet used primarily in retail food and supermarket outlets. More specifically, it relates to a device to be used with such cases during the defrosting of the cases by the circulation of ambient air.

The term "refrigerated", in accordance with the present invention is intended to incorporate those cases maintained at a temperature at or in excess of 32° F. such as display cases utilized for display of milk and fresh foods, and those cases maintained below 32° F., such as frozen food cases.

In the operation of all types of refrigerated display cabinets, it is desirable to include a system for automatically defrosting the refrigeration coils. The defrost cycle can be actuated either at set periodic time intervals or when the frost build-up within the system has reached a certain predetermined level. Such systems are typically thermostatically controlled so as to switch from a refrigeration cycle to a defrost cycle of operation. In this manner of operation, it is possible to avoid any significant frost build-up within the display cabinet such that inoperability and spoilage of the stored food products would occur.

There have been three different approaches for defrosting refrigerated display cabinets in this art. These are, utilizing electric resistance heaters; passing a compressed refrigerant gas having a high specific heat through a refrigeration coil; and circulating ambient air through a conduit in which refrigeration coils are positioned. Due to the increased cost of energy, efforts have been made to place more emphasis on the utilization of ambient air defrost systems as an alternative to electrical resistance heaters or compressed refrigerant gas defrost systems.

When ambient air surrounding the refrigerated display case is drawn in and utilized as a source of thermal energy in order to defrost the refrigeration coils, the ambient air after passing through the iced coils can be at a low temperature. In such a condition, the ambient air does not cause thermal shock to the stored products if it should come in contact therewith during a defrost cycle of operation. However, during the terminal portions of the defrost cycle the defrost ambient air is elevated in temperature above the temperature of the air mass surrounding the stored products and hence will cause thermal shock when coming into contact therewith. This problem is particularly acute in the defrosting of open top cases with ambient air.

One approach to alleviating the problem caused by the defrost ambient air coming into contact with the stored refrigerated products is to construct the case or cabinet with guide means which direct the defrost air upwardly over the access opening during a defrost cycle of operation. German Offenlegungsschrift No. 28 04 008, published Aug. 3, 1978 shows a guide plate 29 in FIG. 1 which directs defrost air upward from the normal flow conduit in order to expell the defrost air to the air space above the stored products.

A similar air guide device is set forth in Australian Patent Specification No. 51774/79 wherein an inverted U-shaped channel is used to guide ambient defrost air away from the stored refrigerated products and downwardly toward the outside of the display cabinet.

Another solution to the above stated problem is set forth in U.K. Patent Application No. 2016669A wherein the changing thermal and volumetric differences between the defrost ambient air band and the air mass surrounding the stored products are utilized together with a means to create a negative pressure in the display space so that the defrost air is first permitted into the display space and is thereafter caused to be directed away from the display space without the provision of special guide means.

U.S. Pat. No. 3,324,783, to Hickox, assigned to the same assignee as is the present invention, discloses a restricting slot 18 in an air conduit for a different purpose. In that patent, the restriction slot causes a back pressure which results in a uniform distribution of the propelled air along the longitudinal dimension of the merchandise cabinet so that the air flow is uniform prior to passing through an air directing grid structure. The purpose of the grid structure is to allow the refrigerated air band to flow more uniformly across the open top of the cabinet. There is no provision in this patent for expelling an air band away from the cabinet.

U.S. Pat. No. 3,996,763 to Karashima discloses a number of perforated baffles which permit the volume of refrigerated air inside of the cabinet to be adjusted with respect to the air outside of the cabinet in the food market. U.S. Pat. No. 4,148,197 to Karashima discloses an interior conduit wall flap which is openable to permit the flow of ambient defrost air into a portion of the second air conduit during the defrost cycle.

U.S. Pat. No. 4,120,174 to Johnston discloses an open top refrigerated case in which a greater air flow is employed during the defrost cycle. The defrost air is then ejected in a vertical direction at the front of the case through a specially designed bioriented air grille. The case also contains air flow restriction devices which offer greater flow resistance during the refrigeration air flow direction whereby the flow rate during the defrost mode is greater than during the refrigeration mode. The linear flow rate increase which temporarily occurs as the defrost ambient air band is forced through a venturi-like restriction is not employed to impart higher momentum to the air band in order to eject it from the cabinet since this restriction means produces only a temporary increase in velocity. The defrost air band velocity appears to be constant throughout other portions of the conduit. The momentum of the defrost air is then only elevated above the momentum of the refrigeration cycle air band by reason of the greater resistance to flow in the refrigeration mode.

SUMMARY OF THE INVENTION

An improvement in refrigerated cases is provided in which an air flow restriction baffle is positioned adjacent to the discharge end of the air conduit containing the circulated defrost ambient air. The ambient air band upon coming into contact with the baffle increases in linear velocity and hence momentum sufficiently to cause the expelled air band to flow away from the access opening of the refrigerated display case. The baffle forms a restricted air flow cross-sectional area which can be about 50% to 90% of the cross-sectional areea of the air conduit immediately preceding the position of the baffle. Such cross-sectional area reductions permit a linear velocity increase of approximately 10% to 100% based on the velocities normally used in display cabinets during a defrost cycle of operation. The restriction baffle can also be aligned with respect to the access opening so that ambient defrost air is guided away from the stored products by reason of the alignment of the flow vectors of the air band along a plane passing out of the access opening.

It is, therefore, an object of the present invention to provide an improved ambient air defrost means for a refrigerated display cabinet having a customer access opening therein wherein an air flow restriction baffle is positioned adjacent to the end of the air conduit through which the air is expelled from the cabinet.

Another object is to form the air flow restriction baffle so that the cross-sectional area at the restriction is reduced to about 50% to 90% of the cross-sectional area of the air conduit immediately preceding the position of the baffle.

Other objects are to provide a display cabinet and a method for operating the same which include the above improvements.

DETAILED DESCRIPTION OF THE PREFERRED EMBODIMENTS

Figure 1:
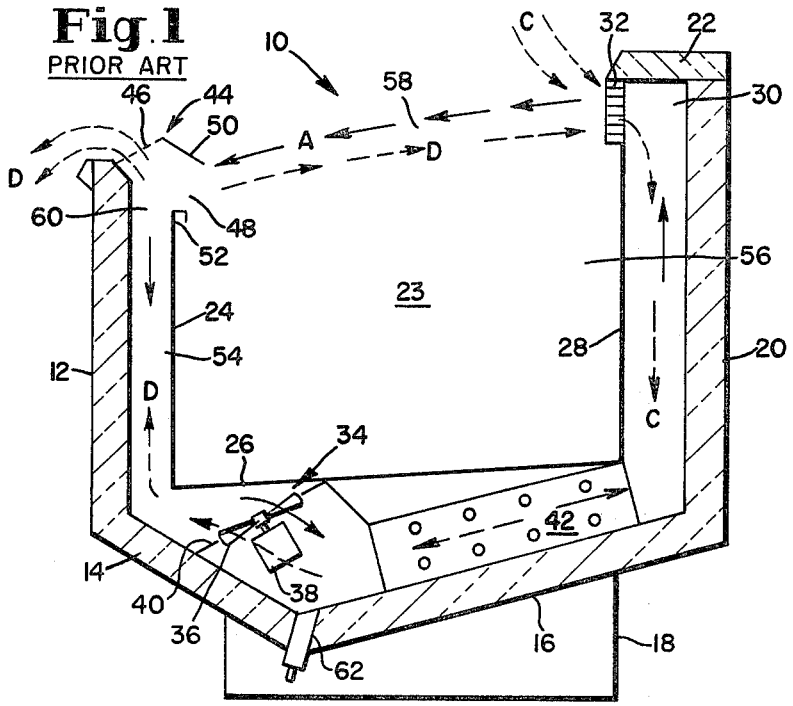
Fig. 1 PRIOR ART
FIG. 1 shows a schematic cross-sectional view of an open top refrigerated display cabinet which illustrates the recirculation problem encountered with defrost air bands.

FIG. 1 shows an open-top refrigerated display cabinet 10 having a front wall 12 which is connected along the lower edge thereof to a front inclined bottom wall 14. A rear portion bottom wall 16 is connected along the rear edge of bottom wall 14 in order to form a shallow V-shaped bottom structure which rests on support 18. A rear wall 20 is connected to the rear edge of bottom wall 16 and has a top forward extended lip 22 resting horizontally thereon. The outer walls 12, 14, 16, 20, and 22 are insulated in order to protect the refrigerated air band contained within the display cabinet 10 from excessive heat transfer from the outside ambient air. The cabinet has two end walls illustrated by the one end wall 23.

A front inner panel 24 is spaced from and is positioned generally parallel to front wall 12. The bottom edge of inner partition 24 is connected to an inner bottom panel 26 which is, in turn, connected along its rear edge to rear inner panel 28. An air outlet and inlet opening 30 is formed by the cooperation of rear wall 20, horizontal lip 22 and rear inner panel 28. Horizontally directed louvers 32 are positioned contiguous to opening 30.

An air moving means 34 is located between bottom walls 14 and 16 and inner bottom panel 26. This means 34 consists of a fan 36 and a powering motor 38 which are supported by a bracket panel 40. Also positioned below bottom panel 26 is a set of refrigeration coils 42 which is designed to allow air passage therethrough as shown by the flow arrows.

An air grille 44 is positioned at the top edge of front wall 12 and has perforations 46 located therein to permit the out flow of air. The air grille 44 is constructed to form an opening 48 between its lower most inner lip 50 and the top edge 52 of the front inner panel 24. The outer walls and the inner walls of the cabinet 10 form an air conduit 54 in which an air band can be circulated by the air moving means 34. Motor 38 is reversible so that the air band can be circulated in both directions within air conduit 54 as shown by the flow arrows.

During a refrigeration cycle the air band is circulated in a counterclockwise direction as shown by the solid line arrows A. This air stream then refrigerates the product display space 56 which is surrounded by the inner panels. During the refrigeration cycle the air moving means 34 circulates refrigerated air band A through the air conduit 54 and across the access opening 58 defined by the top portion of the case 10. Air band A flows under the lower lip 50 of the air grille 44 and into an air inlet 60 located at the top of the left side of air conduit 54.

During the defrost cycle of operation, the flow of refrigerant gas and the refrigeration coil set 42 is terminated and the direction of rotation of the air moving means 34 is reversed so that an ambient air band C is circulated in a clockwise direction through the air conduit 54. Ambient air is drawn in from the air space above the cabinet 10 and propelled through the conduit 54 whereby the warmer ambient air causes the ice and frost accumulated on the coils in coil set 42 to melt and drain through a bottom drain 62. After passing through the air moving means 34 the defrost ambient air band D flows upperwardly in the left hand portion of the conduit 54 and passes through both the air grille perforations 46 and through conduit opening 48 as shown by the defrost air dashed arrows. The portion of the defrost ambient air which passes through opening 48 can then come into contact with the products stored in display space 56 and cause thermal shock and even spoilage of these products.

It is normally desirable in food market stocking practices to present the stored products at the highest possible level in the open top cases, hence, the stored products are in physical contact with the air stream passing over the access opening 58. The defrost ambient air band D is drawn across the access opening 58 from conduit opening 48 by reason of the partial vacuum created in the air inlet and outlet opening 30 by reason of the action of the air moving means 34. It is desirable to prevent the movement of the defrost ambient air band across the stored products in the cabinets. While the initial air in the defrost ambient air band may be initially cooled by contact with the mass of ice in the refrigeration coils, the terminal portions of the defrost cycle do not permit the cooling of the air sufficiently to protect against thermal shock to the stored products. Hence, a means to expel the ambient defrost air completely out of the display cabinet 10 and away from the access opening 58 has considerable utility.

Figure 2:
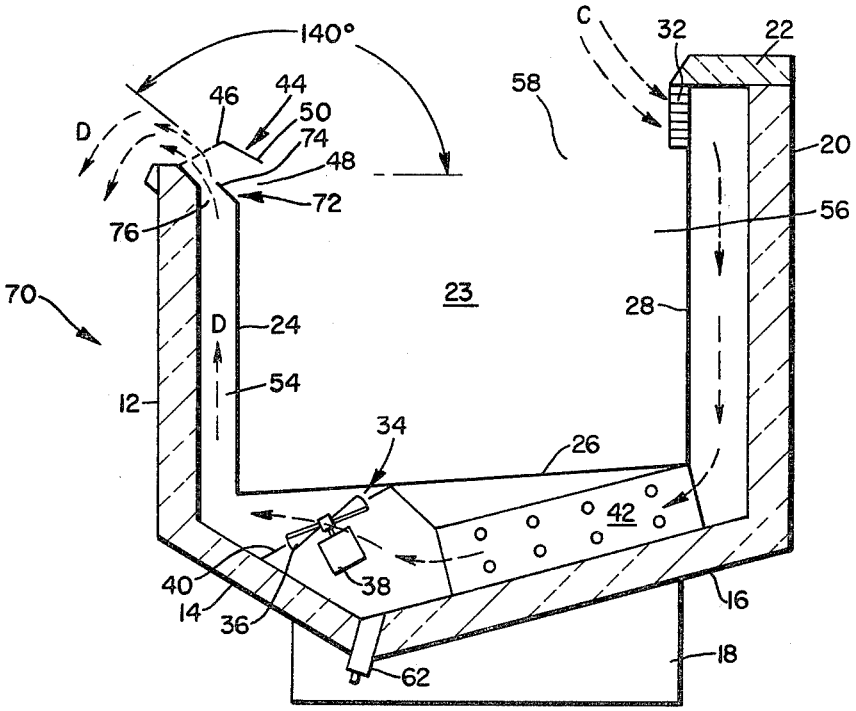
FIG. 2 shows a schematic cross-sectional view of an open top refrigerated display cabinet according to the present invention when operated in a defrost mode.
Figure 3:
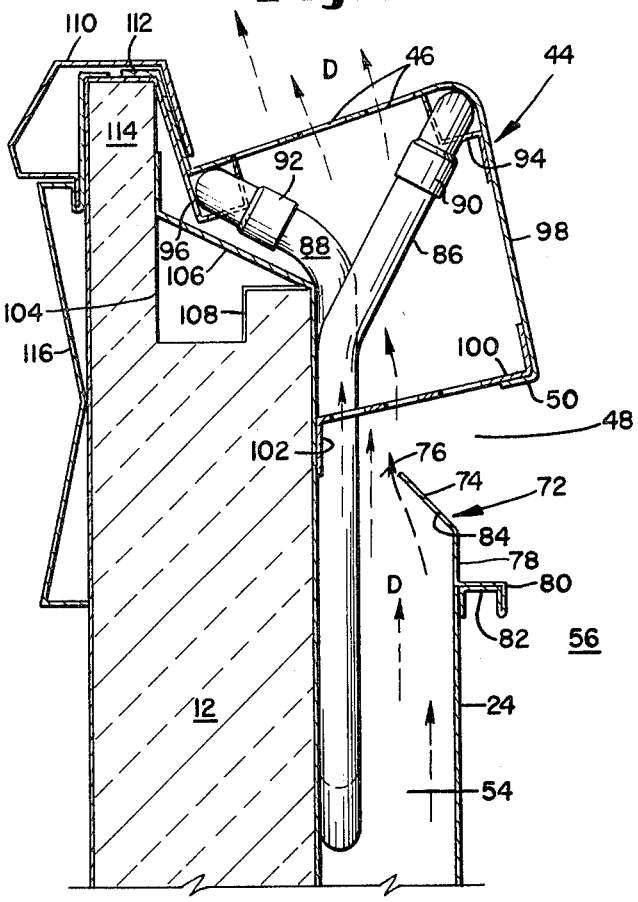
FIG. 3 is an enlarged fragmentary view of the defrost air outlet structure of FIG. 2 showing the air flow restriction baffle during a defrost cycle of operation.

Referring now to FIGS. 2 and 3, an open top display cabinet 70 is shown during operation in a defrost cycle. The construction elements of cabinet 70 are similar to those described with respect to cabinet 10 in FIG. 1 and hence consistent numerical identifications have been used for FIG. 2 where possible. An air flow restriction baffle 72 is affixed along the upper edge of inner front panel 24. The flow area of the air conduit 54 for a cabinet 12 feet in length is approximately 1.5 square feet since the width of the conduit is 1.5 inches. This cross-sectional area within conduit 54 is defined as a 100% cross-section. The air flow restriction baffle 72 is preferably constructed to reduce the air flow cross-section at its upper most lip portion 74 to an approximately 60% cross-section of the area of the air conduit immediately upstream or to an area of 0.9 square feet. Hence, the distance between the upper lip 74 and the inside surface of front wall 12 at the restricted flow area 76 is approximately 0.9 inch.

The air volume passing through the unrestricted portion of the air conduit 54 is defined by the following equation:

$$Q = A \times V \qquad \text{(Eq. 1)}$$

where, Q is the volumetric flow in cubic feet per minute; A is cross-sectional area in square $ft^2$; and V is air velocity in feet per minute.

The air velocity, $V_1$, of the ambient air band stream C circulated by the air moving means 34 can be approximately 200 ft. per minute for purpose of such calculations. Since the volumetric flow rate, Q, will remain equal at the point of the air moving means 34 and through the restricted flow area 76, the velocity of the air passing through the restriction baffle 72, $V_2$, can be calculated as follows:

$$Q = A \times V_1$$

$$= 1.5\ ft^2 \times 200\ fpm$$

$$= 300\ ft^3 \text{ per minute through the air conduit 54}$$

$$V_2 = \frac{Q}{A} = \frac{300}{0.9} = 333.34 \text{ ft per minute through the flow area.}$$

Thus, restricting the flow area from 100% in the conduit to a 60% area illustrated by restriction area 76, results in a reduction in area of 40% and increases the air flow velocity from 200 feet per minute to 333.34 feet per minute. This is a linear velocity increase of 66%. This linear air velocity increase thus increases the momentum of the air stream according to the equation:

$$\Delta M = m \times (V_2 - V_1) \qquad \text{(Eq. 2)}$$

where, $\Delta M$ = change in momentum in pound × minutes; m = mass of air in $$\frac{\text{pounds} \times \text{minutes}^2}{\text{feet}}$$

and is obtained by dividing the the weight of a given air volume by the gravitational constant expressed in consistent units; and $V_2$ and $V_1$ are the velocities in feet per minute. The increased momentum in the air band D is then sufficient to cause the air band to be substantially fully propelled upward through air grille 44 and then to the outside of the front of the cabinet 70. This increased velocity and hence momentum then prevents a rearward moving slip stream of defrost air from flowing across the access opening 58 and contacting the displayed products stored in the cabinet as illustrated by FIG. 1.

The construction, mode of operation, and result of using the air flow restriction baffle 72 is a subtle yet effective mechanism for preventing the above described problem of thermal shock and spoilage of refrigerated food products stored in open-top cabinets of the type described with respect to FIGS. 1 and 2.

It is also possible to use a air flow reduction cross-section of approximately 80% of the area of the air conduit 54 and hence to have the restriction area 76 equal to about 1.2 $ft^2$. In the above described example of a cabinet 12 feet in length, this would represent a gap distance of 1.2 inches. In such a case, the air band velocity would be increased by about 40% since the relationship of the flow area to the velocity tends to be inversely proportional over a wide range of cross-sectional areas according to the above equations.

A plurality of air moving means 34 illustrated by fan 36 and reversible motor 38 are spaced along the length of cabinet 70 shown in FIG. 2. For example, two each of these fans are normally provided for an eight feet long case or three each of the fans are provided for a twelve feet case. By way of example, but not limitation, the overall height of cabinet 70 is approximately 33 to 40 inches and the width ranges from 41 to 55 inches. Such cabinets are manufactured in various lengths.

FIG. 3 shows an enlarged fragmentary view of the top portion of front wall 12 and inner front panel 24 with the preferred air flow reduction baffle 72 mounted thereon for reducing the air flow cross-section from the 100% area of 1.5 $ft^2$ which exists in conduit 54 to approximately 60% at the restriction flow area 76. As the air band D passes through the restriction area 76 the velocity increases approximately 66% and thus the momentum also increases whereby the resulting defrost air band D is propelled upwardly through the air grille 44, and through openings 46 located therein and thus passes outwardly away from the access opening 58 as shown in FIG. 2.

The simplicity of construction of the restriction baffle 72 can be more fully appreciated in FIG. 3 wherein the baffle is formed of a short vertical section 78 which is integrally joined to an L-bracket 80. This L-bracket is designed to be clipped onto an inverted U-shaped channel member 82 which is affixed to the top most portion of inner panel 24. In this manner, the restriction baffle 72 can be clipped to the existing inner panel construction without extensive modification of the internal portions thereof. The remainder of the restriction baffle 72 consists of an inclined upper portion 84 which effectively reduces the air passage area as above described. This simple construction of restriction baffle 72 shows that uncomplicated, yet efficient energy conserving improvements can be discovered to enhance the operation of air defrosted refrigeration display cabinets.

Other details shown in FIG. 3 are the first and second refrigerant gas heater lines 86 and 88 which are shown having elbows 90 and 92 respectively which can be in the form of horizontal lines with integrally formed elbows. The horizontal portions of the refrigerant gas heater lines 86 and 88 are held in place under the air grille 44 by brackets 94 and 96 respectively. Air grille 44 is shown with perforations 46 on the upper surface thereof. A solid inner panel 98 depends from the upper surface and connects with an optional lower perforated plate 100 near the bottom lip 50. The opposite end of perforated plate 100 is attached to the inside surface of front wall 12 by a depending lip 102. The upper end portions 104 of front wall 12 is configured to permit a close fitting of the air grille 44 and the enclosed refrigerant gas heater lines 86 and 88. An inclined top panel 106 is provided for connecting the inverted U-shaped inner portion 108 of the top of front wall 12 with the outer most portions of wall 12. A rub rail 110 is provided for overlying the top portion of the air grille connecting structure 112 and the upper end 114 of front wall 12. A decoration panel 116 shown with a broad V-shaped indentation is located immediately below the rub-rail 110. The product display space 56 is shown to the immediate right hand side of the fragmentary view shown in FIG. 3.

The air flow restriction baffle 72 can be constructed to reduce the cross-sectional flow area of the air conduit to various percentages ranging from 50% to 90% of the unrestricted area. Cross-sectional reductions of these percentages allow air velocity percentage increases ranging from about 100% to about 10%, respectively, at volumetric flow rates close to 300 $ft^3$ per minute (CFM).

The defrost ambient air stream can be circulated through conduit 54 by the air moving means 34 at various volumetric flow rates of from about 200 to 350 CFM. These flow rates are 25% to 50% lower than those used during the refrigeration cycle. Thus typical refrigerated air band volumetric flow rates can range from about 250 CFM to 525 CFM. Preferable flow rates during refrigeration cycle are between 374 CFM to 450 CFM. Preferable flow rates during refrigeration are about 250 CFM to 350 CFM.

During the refrigeration cycle, the air band propelled from air outlet 30 is preferably between 17° F. and 27° F. in a medium temperature display case. The air as received by inlet opening 48 under the air grille 44 is approximately 10° F. to 12° F. higher than the air emitted from the air inlet and outlet opening 30.

As shown by FIG. 2, the construction of air grille 44 permits the refrigerated band to flow horizontally through opening 48 and then the flow of the defrost air band vertically through the perforated upper panel 46 during the defrost cycle. By this construction the air grille facilitates a two directional air flow pattern wherein the axes of the flow openings are positioned from about 90° to 140° of one another. This construction coacts with restriction baffle 72 to permit the air bands circulated during the refrigeration and the defrost cycles to be handled in a separate energy efficient manner since the defrost air band then remains substantially out of contact with the stored refrigerated products.

Figure 6:
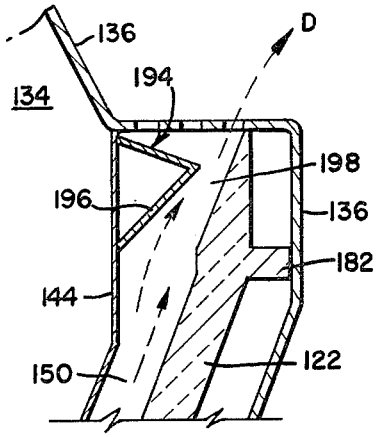
FIG. 6 is an enlarged fragmentary view of the defrost air outlet structure of FIGS. 4 and 5.
Figure 4:
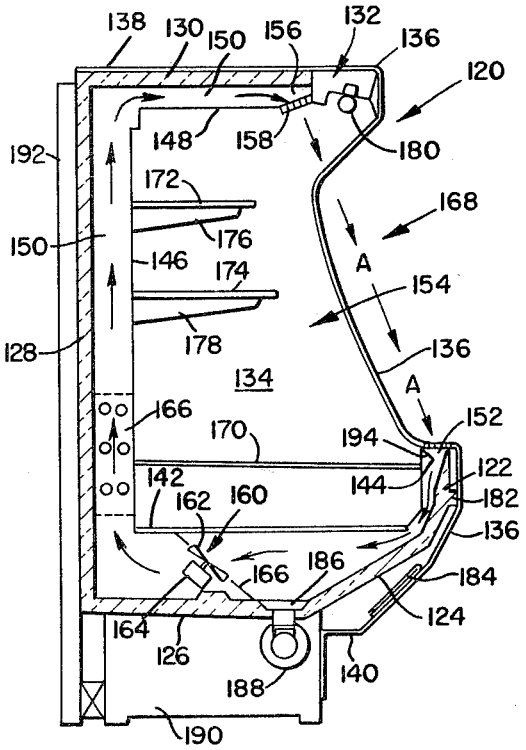
FIG. 4 shows a schematic cross-sectional view of an open front refrigerated display cabinet according to the present invention when operated in a refrigeration cycle.
Figure 5:
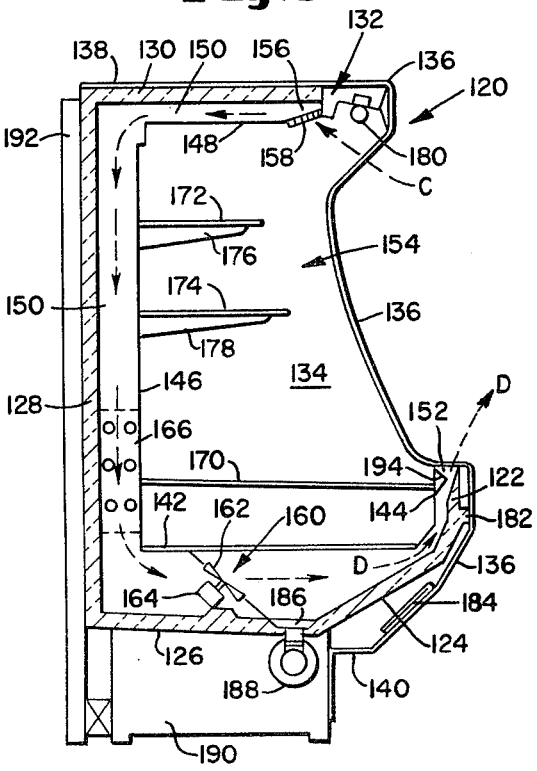
FIG. 5 shows the cabinet of FIG. 4 when operated in defrost cycle.

Referring now to FIGS. 4–6, an open front refrigerated display cabinet 120 is shown constructed with a front wall 122 which has a rearward sloping bottom section 124 connected to a horizontally disposed bottom wall 126 which is in turn connected by its rear edge to a vertical rear wall 128. A top wall 130 is then connected to the top edge of rear wall 128 and provides a support for a front overhead light fixture 132. The outer walls 122, 124, 126, 128 and 130 are connected to an end wall 134 which is shown with a trim member 136 extending therefrom on the front side which has, as extensions, a top portion 138 and a lower front portion 140. An inner bottom panel 142, and inner front panel 144, an inner rear panel 146 and a top inner panel 148 are spaced from the outer walls in order to form an internal air conduit 150 which extends from an air inlet and outlet port 152 located at the top of front wall 122 about the defined product display space 154. An air inlet and outlet opening 156 is formed between the front portions of top wall 130 and inner panel 148 and is covered by generally downwardly directed louvers 158. An air moving means 160 is located in the bottom portion of cabinet 120 between the bottom wall 126 and the bottom inner panel 142. This air moving means consists of a fan 162 which is powered by a reversible electric motor 164. The fan and motor are supported in a bracket panel 166. A set of evaporator refrigeration coils 166 is positioned within conduit 150 between outer wall 128 and inner panel 146. Air moving means 160 propels a refrigerated air band A in a clockwise direction upwardly in conduit 150 through the evaporator coil set 166 and then through the inlet and outlet port 156. The louvers 158 direct air stream A downwardly along the access opening 168 in order to protect the products stored within product display space 154 from contact with the outside ambient air. A display shelf system is illustrated by bottom display shelf 170 and a top shelf 172 and an intermediate position display shelf 174. Shelves 172 and 174 are supported by brackets 176 and 178, respectively.

The front upward light housing 132 has a series of fluorescent light bulbs illustrated by bulb 180 affixed therein.

A rub rail 182 is provided at the customer side of the front wall 122 and additional decorative panels such as panel 184 can be provided if desired. A bottom drain channel 186 is provided at the juncture of bottom wall section 124 and horizontal bottom wall 126 and is connected to a drain line 188 located under the cabinet 120. A support 190 is provided for elevating the cabinet 120 away from the floor surface. The end wall 134 has a rearwardly extending section 192 which aids in positioning the cabinet 120 against vertical walls.

FIG. 5 shows refrigerated display cabinet 120 operated in a defrost cycle in which an ambient air band C is circulated by air moving means 160 in a counterclockwise direction through air conduit 150 in order to bring ambient air into contact with the refrigeration coils 166. After contact with the ice and frost on the refrigeration coil set 166 the defrost air band D flows upwardly and outwardly from the front portion of cabinet 120 as shown by the dashed line arrows. The upward and outward flow of the defrost air band D away from air inlet and outlet port 152 is controlled by the air flow restriction baffle 194 which is shown in fuller detail in FIG. 6. The front portion of air conduit 150 is shown extending upwardly to a position where the bottom sloped surface 196 of baffle 194 reduces the flow area to approximately 60% of the cross-sectional area available for air flow in the conduit 150. This reduced flow area 198 produces the effect described above of increasing the linear air velocity of the defrost air band by approximately 66% which then increases the momentum of the defrost air D sufficiently to expel the same outward and away from the access opening 168. In this manner the defrost air does not come in contact with the product display space 154 whereby thermal shock and possible spoilage of stored products could occur.

A plurality of air moving means 160 are spaced along the length of cabinet 120, for example, two each of these fans are normally provided for an eight feet long case or three each for a twelve feet case. By way of example, but not limitation, the overall height of cabinet 120 can be about 82 inches and the width about 45 inches. Such cabinets are manufactured in lengths up to 72 feet.

The air flow restriction baffle illustrated as baffles 72 and 194 in FIG. 2–6 can be utilized in the inner air conduits of multi-air band refrigerated display cabinets in a similar manner to that shown by the above figures and described herein. In such an embodiment the air flow restriction baffle is positioned as shown in the FIGS. 2–6 in the inner air conduit located about the display space and the outer conduit is constructed in a manner so that the conduit elements and the air band flowing therein does not obstruct the exit path of the defrost air band.

It is also possible to utilize the air flow restriction baffle of the present invention with refrigerated cabinets having barrier doors thereon with a suitable provision being made for the expulsion of defrost air from the air conduit either by means of air passing through a gap created in the door and/or by means of separate inlet and outlet ports.

The air flow restriction baffle can have various shapes and designs consistent with the flow area reduction and air guiding functions described herein.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. In a refrigerated display cabinet having outer walls defining a product storage and display space and having an access opening in one of said walls for permitting products to be moved into and out of said storage and display space; at least one air conduit disposed about said storage and display space for containing an air band; a refrigeration means; air moving means enabling circulation of an air band within said conduit and across said access opening in a refrigeration cycle of operation; and said air moving means also permitting circulation of an ambient air band during a defrost cycle; the improvement comprising an air flow restriction baffle positioned within said air conduit adjacent to the discharge end of said air conduit when said cabinet is operated in an air defrost cycle, and said air flow restriction baffle operable to increase the velocity of the air band in said conduit during a defrost cycle sufficiently to expel the defrost air band substantially out of said cabinet.

2. The improvement according to claim 1, wherein said display cabinet is constructed with an open top which forms said access opening and wherein said air flow restriction baffle is located adjacent to a front wall of said cabinet.

3. The improvement according to claim 1, wherein said cabinet is constructed with an open front wall which forms said access opening and wherein said air flow restriction baffle is located near the bottom of said access opening.

4. The improvement according to claim 1, wherein said air flow restriction baffle is integrally formed in a terminal portion of an inner panel of said air conduit.

5. The improvement according to claim 1, wherein a second air conduit is positioned about the outside of said first air conduit for enabling circulation of a second air band.

6. The improvement according to claim 1, wherein an air grille is positioned adjacent to said air flow restriction baffle and wherein ambient air circulated through said restriction baffle passes through said air grille prior to expulsion from said cabinet and away from said access opening during a defrost cycle of operation.

7. The improvement according to claim 6, wherein heater elements are integrally formed in said air grille to prevent the formation of moisture condensate thereon.

8. The improvement according to claim 1, wherein a terminal portion of said air flow restriction baffle is formed along a plane which passes through and extends away from the plane established by said access opening, and wherein said baffle also functions to guide defrost ambient air out of said cabinet.

9. The improvement according to claim 1, wherein said air flow baffle forms a restricted air flow cross-sectional area which is reduced to at least about 50% to 90% of the cross-sectional area of said air conduit immediately upstream of said baffle.

10. The improvement according to claim 1, wherein said defrost ambient air band velocity is increased by about 66%.

11. The improvement according to claim 1, wherein said ambient air band volumetric flow rate in the defrost cycle is 25% to 50% lower than during the refrigeration cycle.

12. The improvement according to claim 1, wherein said air flow restriction baffle forms a restricted air flow cross-sectional area which is reduced to about 80% of the cross-sectional area of said conduit immediately upstream of said baffle.

13. The improvement according to claim 12, wherein said defrost air band velocity is increased by about 40%.

14. The improvement according to claim 1, wherein an air grille is positioned in the flow path of the ambient air band downstream from said restriction baffle during a defrost cycle, and wherein said air grille enables through-flow of said ambient air band during a defrost cycle in a vertically-oriented direction and flow of a refrigerated air band in a horizontally-oriented direction.

15. The improvement according to claim 14, wherein the flow direction of said ambient and said refrigerated air bands are at angles of about 90° to 140° of one another.

16. A refrigerated display cabinet having bottom, side and end walls and an access opening for enabling access to products displayed within said cabinet, said walls and said top side defining a product storage and display space, and an air moving means enabling circulation of an air band in a refrigeration cycle and in a defrost cycle, and a refrigeration means arranged for contact by the air band during a refrigeration cycle said cabinet comprising:

at least one air conduit arranged about said product storage and display space for enabling circulation of a refrigerated air band and said conduit having an air outlet opening and an air inlet opening at opposite ends thereof so that air leaving said outlet opening is directed across said access opening and received into said inlet opening during a refrigeration cycle of operation;

said air moving means enabling propulsion of air through said conduit in a first direction during a refrigerated cycle and propulsion of ambient air in a second direction during a defrost cycle of operation; and an air flow restriction baffle positioned within said air conduit adjacent to the discharge end of said air conduit when said cabinet is operated in a defrost cycle, said restriction baffle operable to increase the velocity of the air band during a defrost cycle sufficiently to expel the defrost air band substantially out of said cabinet away from said access opening.

17. The display cabinet according to claim 16, wherein said display cabinet is constructed with an open top which forms an access opening therein and wherein said air flow restriction baffle is located adjacent to a front wall of said cabinet.

18. The display cabinet according to claim 16, wherein said cabinet is constructed with an open front wall which forms said access opening and wherein said air flow restriction baffle is located near the bottom of said access opening.

19. The display cabinet according to claim 16, wherein said air flow restriction baffle is integrally formed in a terminal portion of an inner panel of said air conduit.

20. The display cabinet according to claim 16, wherein a second air conduit is positioned about the outside of said first conduit containing said refrigerated band for enabling circulation of a second air band.

21. The display cabinet according to claim 16, wherein an air grille is positioned adjacent to said air flow restriction baffle and wherein ambient air circulated through said restriction baffle passes through said air grille prior to expulsion from said cabinet and away from said access opening during a defrost cycle of operation.

22. The display cabinet according to claim 21, wherein heater elements are integrally formed in said air grille to prevent the formation of moisture condensate thereon.

23. The display cabinet according to claim 16, wherein a terminal portion of said air flow restriction baffle is formed along a plane which passes through and extends away from the plane established by said access opening, and wherein said baffle also functions to guide said ambient air out of said cabinet.

24. The display cabinet according to claim 16, wherein said air flow baffle forms a restricted air flow cross-sectional area which is reduced to at least about 50% to 90% of the cross-sectional area of said air conduit immediately upstream said baffle.

25. The display cabinet according to claim 16, wherein said ambient air band volumetric flow rate in the defrost cycle is 25% to 50% lower than during the refrigeration cycle.

26. The display cabinet according to claim 16, wherein said air flow restriction baffle forms a restricted air flow cross-sectional area which is reduced to about 80% of the cross-sectional area of said air conduit immediately upstream of said baffle.

27. The display cabinet according to claim 26, wherein said defrost air band velocity is increased by about 40%.

28. The display cabinet according to claim 16, wherein said defrost ambient air band velocity is increased by about 66%.

29. The display cabinet of claim 16, wherein said cabinet has a barrier door movably affixed thereto for covering said access opening.

30. The display cabinet of claim 29, wherein said cabinet has means arranged therein for enabling said barrier door to be opened to permit throughflow of ambient air during a defrost cycle.

31. The display cabinet of claim 16, wherein an air grille is positioned in the flow path of the ambient air band downstream from said restriction baffle during a defrost cycle, and wherein said air grille enables through-flow of said ambient air band during a defrost cycle in a vertically-oriented direction and flow of a refrigerated air band in a horizontally-oriented direction.

32. The display cabinet according to claim 31, wherein the flow direction of said ambient and said refrigerated air bands are at angles of about 90° to 140° of one another.

* * * * *